US007057143B2

(12) United States Patent
Sakamoto et al.

(10) Patent No.: US 7,057,143 B2
(45) Date of Patent: Jun. 6, 2006

(54) FIXING HEATER AND IMAGE FIXING APPARATUS INCORPORATING THE SAME

(75) Inventors: Masamitsu Sakamoto, Kyoto (JP); Hiroshi Fukumoto, Kyoto (JP); Teruhisa Sako, Kyoto (JP)

(73) Assignee: Rohm Co., Ltd., Kyoto (JP)

( * ) Notice: Subject to any disclaimer, the term of this patent is extended or adjusted under 35 U.S.C. 154(b) by 13 days.

(21) Appl. No.: 10/405,096

(22) Filed: Mar. 31, 2003

(65) Prior Publication Data

US 2004/0247350 A1 Dec. 9, 2004

(30) Foreign Application Priority Data

Apr. 1, 2002 (JP) ..... 2002-098820

(51) Int. Cl.
*H05B 3/44* (2006.01)

(52) U.S. Cl. ..... 219/544; 219/216; 219/543

(58) Field of Classification Search ..... 219/542–546, 219/216, 469, 470; 338/307–309; 347/203–204, 347/206, 209, 61, 62
See application file for complete search history.

(56) References Cited

U.S. PATENT DOCUMENTS

| | | | | |
|---|---|---|---|---|
| 5,304,784 | A | 4/1994 | Tagashira et al. | |
| 5,306,898 | A | 4/1994 | Yukawa et al. | |
| 5,321,234 | A * | 6/1994 | Ooyama et al. | 219/543 |
| 5,376,773 | A * | 12/1994 | Masuda et al. | 219/543 |
| 6,323,460 | B1 * | 11/2001 | Ohtsuka | 219/216 |
| 6,469,279 | B1 * | 10/2002 | Ohtsuka | 219/216 |

FOREIGN PATENT DOCUMENTS

| | | |
|---|---|---|
| JP | A-7-192856 | 7/1995 |
| JP | 408063016 A * | 3/1996 |
| JP | A-11-338293 | 12/1999 |

* cited by examiner

*Primary Examiner*—Robin Evans
*Assistant Examiner*—Vinod Patel
(74) *Attorney, Agent, or Firm*—Hamre, Schumann, Mueler & Larson, P.C.

(57) ABSTRACT

A fixing heater includes a substrate, a relatively narrow first heating resistor strip formed on the substrate, and a relatively wide second heating resistor strip formed on the substrate substantially in parallel to the first heating resistor strip. The second heating resistor strip is formed with a plurality of slits extending longitudinally of the strip.

11 Claims, 5 Drawing Sheets

FIXING HEATER AND IMAGE FIXING APPARATUS INCORPORATING THE SAME

BACKGROUND OF THE INVENTION

1. Field of the Invention

The present invention relates to a fixing heater and to an image fixing apparatus incorporating the same.

2. Description of the Related Art

A fixing heater is incorporated in the heating unit of a printer, for example, to provide heat for fixing a toner image formed on a recording medium such as a paper sheet. Toner used for monochromatic print includes resin and a black-coloring material (carbon black for example). Thus, to fix the toner image onto the recording medium, the fixing heater needs to quickly melt the resin material in the toner, and to continue the heating for over a certain period of time so that the melted resin is fixed to the recording medium.

JP-A-11-338293 discloses a fixing heater with two heating resistor strips formed in parallel on a substrate. The heating resistor strips, having the same width, are both narrow. Accordingly, the heating resistor strips have high resistance, which is advantageous in generating sufficient heat per unit area. However, the narrow width makes it difficult to ensure a large heating area required for having an appropriately long heating time.

JP-A-7-192856 discloses a heater with three parallel electrode strips formed on a substrate, the electrode strips being bridged by a number of heating resistors extending transversely to the electrode strips. With the heating resistors arranged in parallel to each other, the disconnection of any one of the heating resistors does not prevent the other heating resistors from continuing to provide heat. Further, since each heating resistor extends transversely to the electrode strips, the heater can have a large heating region as a whole.

However, the heater disclosed in JP-A-7-192856 (used for anti-clogging protection of the print head of an inkjet printer) fails to heat the areas between the adjacent heating resistors due to the parallel arrangement of the heating resistors with respect to the electrode strips. Therefore, when the heater is used as a fixing heater, the recording medium (printing paper) has a lot of portions unheated in the width direction, whereby the image fixing is not performed properly. Further, since a great amount of electric current passes through the parallel heating resistors, the overall power consumption of the heater tends to be quite large.

SUMMARY OF THE INVENTION

It is, therefore, an object of the present invention to provide a heater capable of melting and fixing toner efficiently with reduction of manufacturing cost.

It is another object of the present invention to provide a fixing apparatus incorporating such a heater.

According to a first aspect of the present invention, there is provided a heater comprising a substrate, a first heating resistor strip formed on the substrate and having a relatively narrow width, and a second heating resistor strip formed on the substrate substantially in parallel to the first heating resistor strip and having a relatively wide width. The second heating resistor strip is formed with at least one slit extending longitudinally thereof.

According to a second aspect of the present invention, there is provided a heater comprising, a substrate, a first heating resistor strip formed on the substrate and having a relatively narrow width, and a second heating resistor strip formed on the substrate substantially in parallel to the first heating resistor strip and having a relatively wide width. The second heating resistor strip is formed with a plurality of slits extending longitudinally thereof.

Preferably, the first and the second heating resistor strips are covered with a protective coating. This protective coating includes a smoothing layer formed between the first and the second heating resistor strips and at the slits, and also includes an overcoating layer formed on the smoothing layer.

Preferably, the slits are formed in a plurality of rows spaced transversely of the second heating resistor strip. The slits in each row are spaced by bridges from each other longitudinally of the second heating resistor strip.

Preferably, one end of the first heating resistor strip is connected to one adjacent end of the second heating resistor strip via a common conductor formed on the substrate. The other end of the first heating resistor strip is connected to a first conductor terminal formed on the substrate, while the other end of the second heating resistor strip is connected to a second conductor terminal formed on the substrate.

According to a third aspect of the present invention, there is provided a fixing apparatus comprising a fixing heater, a power supply for providing electric power with the fixing heater, and a platen roller for pressing a recording medium against the fixing heater. The fixing heater comprises a substrate, a relatively narrow first heating resistor strip formed on the substrate, and a relatively wide second heating resistor strip formed on the substrate substantially in parallel to the first heating resistor strip. The second heating resistor strip is provided with a plurality of slits extending longitudinally of the strip.

Preferably, the platen roller presses the recording medium against the fixing heater in a position facing the first heating resistor strip.

Other objects, features and advantages of the present invention will become clearer from the description of the preferred embodiments given below.

DETAILED DESCRIPTION OF THE PREFERRED EMBODIMENT

Preferred embodiments of the present invention will be described below in detail with reference to the accompanying drawings.

Figure 1:
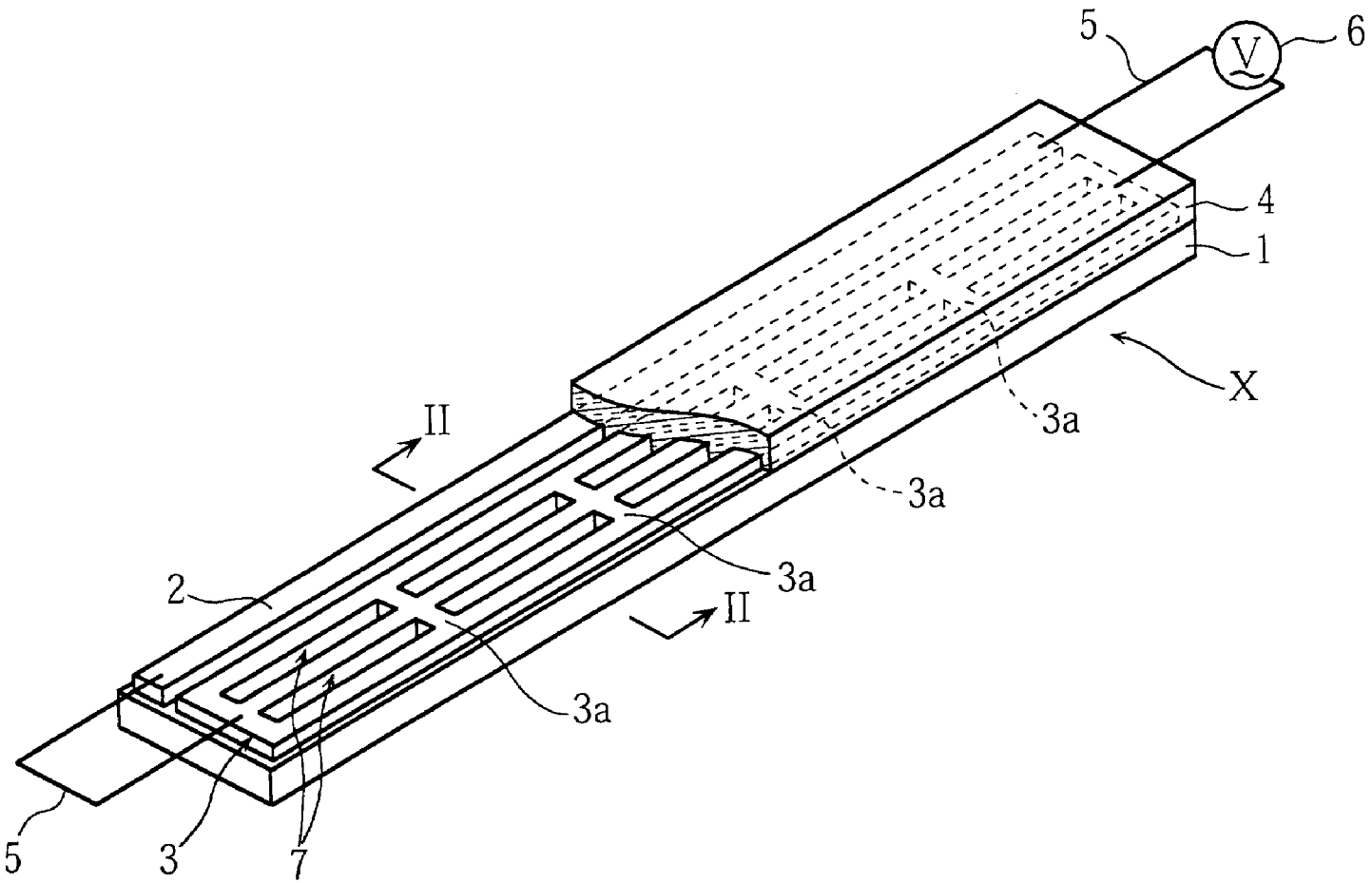
FIG. 1 is a schematic perspective view showing a fixing heater according to an embodiment of the present invention.
Figure 2:
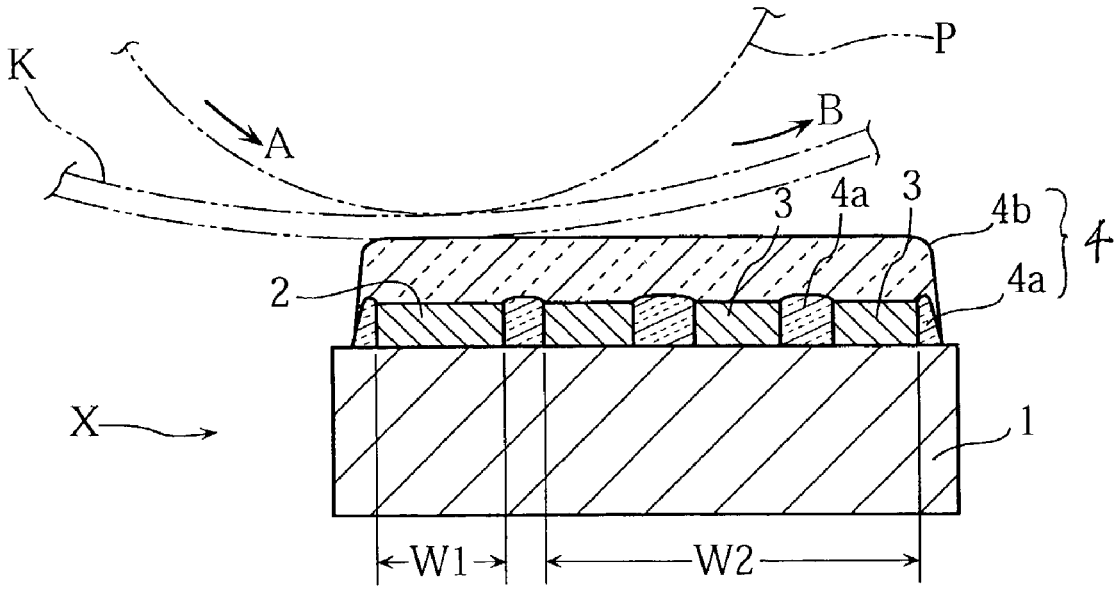
FIG. 2 is a sectional view taken along lines II—II in FIG. 1.

FIGS. 1 and 2 show a first embodiment of the present invention. FIG. 1 shows a fixing heater according to the first embodiment. FIG. 2 schematically shows a fixing apparatus incorporating the fixing heater.

The fixing apparatus of the first embodiment, being provided with a fixing heater X and a platen roller P, is incorporated in an electrophotgraphic printer for fixing toner images on a recording medium K such as a paper sheet. The platen roller P is rotated in the direction represented by an arrow A with electric power supplied by a driving source not shown in the figure. This rotation transfers the recording medium K, held in contact with the fixing heater X, in the direction represented by an arrow B. The recording medium K and the toner image formed thereon are heated by the fixing heater X. As a result, the resin in the toner is melted, and the toner image is fixed to the recording medium.

The fixing heater X includes an elongated, rectangular substrate 1. The substrate 1 is made of alumina ($Al_2O_3$) for example. The substrate 1 is formed with a first heating resistor strip 2 and a second heating resistor strip 3 that are arranged in parallel. Each of the heating resistor strips 2, 3 is made of Ag—Pd for example. Both of the heating resistor strips 2, 3 are covered with a protective coating 4. The protective coating 4 consists of a lower smoothing layer 4*a* and an upper overcoating layer 4*b*, both of which are made of a glass-dominant material.

Each of the heating resistor strips 2, 3 may be connected to an alternator 6 via a wiring 5 for example. Specifically, one end of the first heating resistor strip 2 is electrically connected to the adjacent end of the second heating resistor strip 3, while the other ends of the first and second heating resistor strips 2, 3 are connected to the alternator 6. Consequently, the heating resistor strips 2, 3 are connected in series to the alternator 6, to provide heat with electric power supplied by the alternator 6. Although not shown in FIG. 1, a part of the wiring 5 may be formed on the surface of the substrate 1.

The heating resistor strip 2 has a relatively narrow width W1 and an uniform cross section. The heating resistor strip 2 needs to reach a high temperature in a short time for melting the resin in the toner quickly. In light of this, the width W1 of the first heating resistor strip 2 is made relatively small (the cross section is small, and the resistance is high) so that a relatively large amount of heat is generated. Further, the heat generated by the first heating resistor strip 2 needs to be conducted efficiently to the toner image on the recording medium K. To this end, as shown in FIG. 2, the platen roller P is disposed right above the first heating resistor strip 2 so as to press the recording medium K against the fixing heater X.

For completely fixing the toner image to the recoding medium K, the second heating resistor strip 3 is positioned downstream from the first heating resistor strip 2 in the transfer direction B of the recording medium K. The second heating resistor strip 3 does not need to generate much heat since the resin component of the toner is melt by the first heating resistor strip 2. However, the second heating resistor strip 3 needs to continue the heat provision for the recording medium K until the toner image is fixed. To this end, the second heating resistor strip 3 has a relatively large width W2, whereby a long heat-providing stroke (distance) is ensured for the recording medium K. The heating resistor strip 3 has the substantially same length as the heating resistor strip 2.

In the illustrated first embodiment, the second heating strip 3 has plural rows (two rows in FIG. 1) of slits 7 extending longitudinally of the strip. The slit 7 in each row is divided off by bridges 3*a* extending transversely to the second heating resistor strip 3. The bridges 3*a* provide a lot of current paths. Thus, even in case the current paths suffer a partial defect such as disconnection, the surviving current paths can provide heat. The technical advantage of the slits 7 will be described later.

Figure 3:
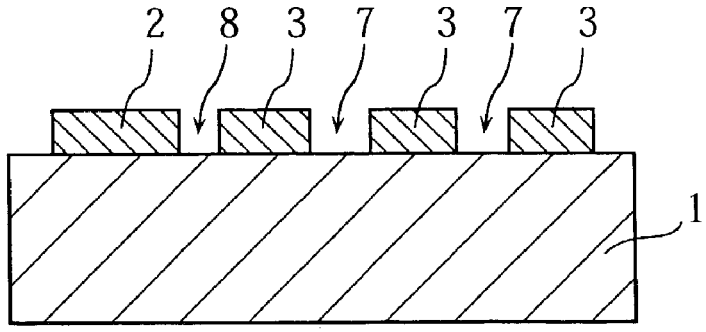
FIGS. 3–5 are sectional views showing process steps of fabricating the fixing heater.

The fixing heater X according to the preferred embodiment is fabricated as follows. First, as shown in FIG. 3, a resistor paste of Ag—Pd is printed on a substrate 1 by screen printing for example. The resistor paste is baked to form heating resistor strips 2, 3. A plurality of slits 7 are formed in the heating resistor strip 3 by this printing process.

The formation of the heating resistor strips 2, 3 provides unevenness on the substrate 1. If a protective coating 4 is made over the uneven area by a single-step printing, the resultant protective coating 4 may have an unflat upper surface. It is desirable, however, that the protective coating 4 has a flat upper surface since the upper surface of the coating 4 comes into contact with a recording medium K.

Figure 4:
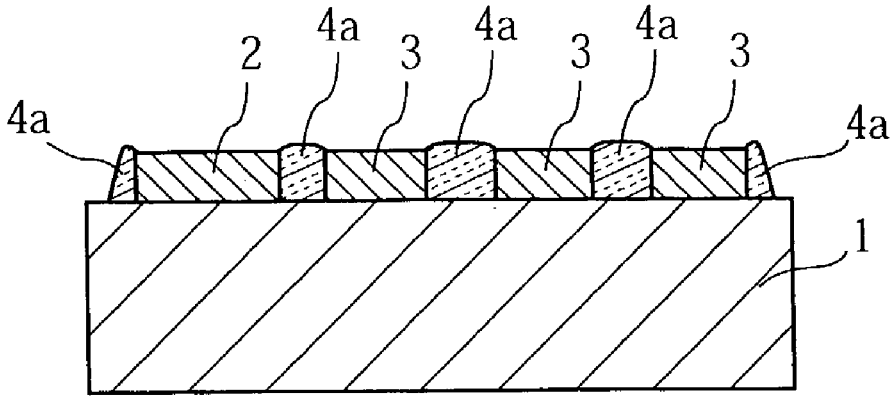

In light of this, as shown in FIG. 4, a smoothing layer 4*a* is formed, for example, in the slits 7 and at gaps 8 between the heating resistor strips 2 and 3. The smoothing layer 4*a* is formed by printing a glass paste and baking it.

Figure 5:
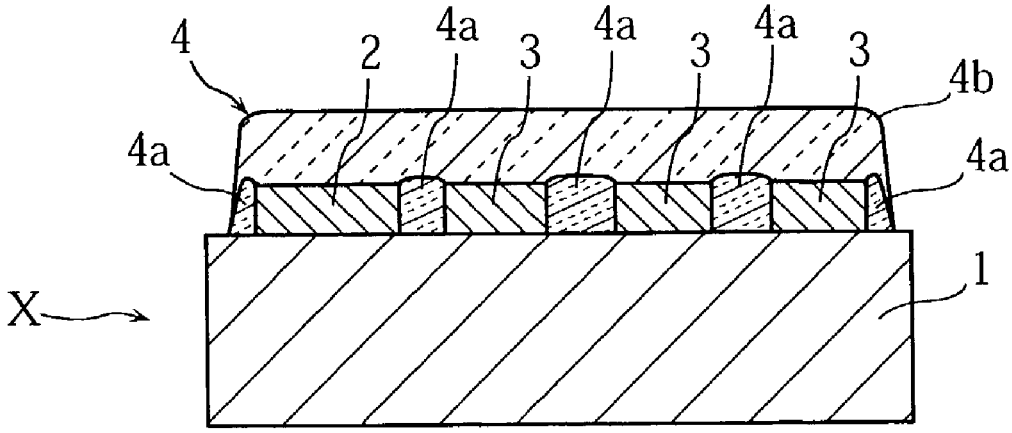

Next, as shown in FIG. 5, an overcoating layer 4*b* is formed to cover the heating resistor strip 2, 3 and the smoothing layer 4*a*. The overcoating layer 4*b* is formed by the printing and baking of a glass paste, as with the smoothing layer 4*a*. Thus, the protective coating 4 consisting of the smoothing layer 4*a* and the overcoating layer 4*b* is obtained. The glass paste used for making the smoothing layer 4*a* may or may not have the same composition as the glass paste used for making the overcoating layer 4*b*.

In the fixing heater X with the arrangements described above, the second heating resistor strip 3 is formed with plural slits 7. Therefore, the material expense for the second heating resistor strip 3 can be lower than the conventional one. With the manufacturing cost reduced, the heating resistor strip 3 can still have a relatively large width W2 (the width of a heating region). Therefore, the heating resistor strip 3 can heat the toner image for a time long enough to fix it to the recording medium K. Further, due to the formation of the slits 7, the second heating resistor strip 3 has a greater resistance. This serves to increase the heat generation, thereby compensating the shortage of heat which would otherwise be generated at the location of the slits 7.

Figure 6:
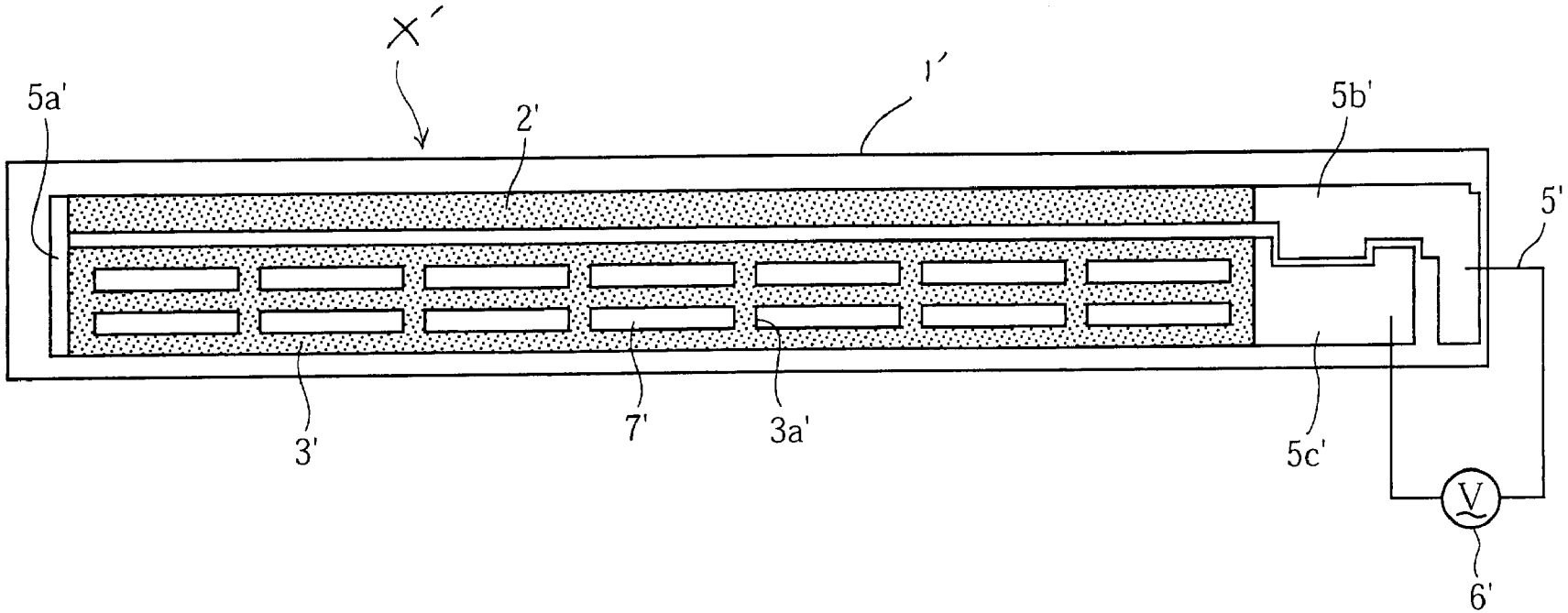
FIG. 6 is a schematic plan view showing a fixing heater according to another embodiment of the present invention.

FIG. 6 shows a fixing heater X' according to a second embodiment of the present invention. As in the first embodiment (FIG. 1), the fixing heater X' of the second embodiment includes a substrate 1'. Upon the substrate 1' are formed a first heating resistor strip 2' having a relatively narrow width and a second heating resistor strip 3' having a relatively wide width. The second heating resistor strip 3' is formed with plural rows (two rows in FIG. 6) of slits 7 extending longitudinally of the strip. One end of the first heating resistor strip 2' is electrically connected to the adjacent end of the second heating resistor strip 3' via a common conductor 5*a*'. The other end of the first heating resistor strip 2' is connected to a first conductor terminal 5*b*', while the other end of the second heating resistor strip 3' is connected to a second conductor terminal 5*c*'. The first and second conductor terminals 5*b*', 5*c*' are connected to an alternator 6'. The first and second conductor terminals 5*b*', 5*c*' are formed by printing a conductor paste on the substrate 1' and baking it.

In the above-described structure of the second embodiment, though not shown in FIG. 6, a protective layer is formed to cover the first heating resistor strip 2', the second heating resistor strip 3' and the common conductor 5*a*', while allowing the first and second conductor terminals 5*b*', 5*c*' to be exposed at least partially. Thus, the fixing heater X' can be conveniently connected to the alternator 6'.

Figure 7:
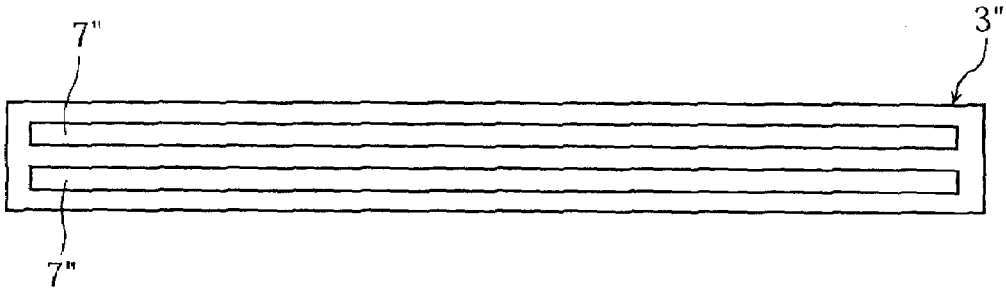
FIG. 7 is a schematic plan view showing a heating resistor strip of the fixing heater according to another embodiment of the present invention.

FIG. 7 shows a second heating resistor strip 3" of a fixing heater according to a third embodiment of the present invention. In this embodiment, the second heating resistor strip 3" is formed with a plurality of longitudinal slits 7" (two slits in FIG. 7) extending continuously along substantially the entire length of the resistor strip.

The preferred embodiments of the present invention being thus described, it is obvious that the present invention is not limited to these embodiments. For instance, the number of the slits or bridges formed in the second heating resistor strip may be varied as required. Further, the heater of the present invention may be used for purposes other than for fixing toner images. Such variations are not to be regarded as a departure from the spirit and scope of the present invention, and all such modifications as would be obvious to those skilled in the art are intended to be included within the scope of the following claims.

The invention claimed is:

1. A heater comprising:

a substrate;

a first heating resistor strip formed on the substrate and having a relatively narrow width; and a second heating resistor strip formed on the substrate substantially in parallel to the first heating resistor strip, the second heating resistor strip having a relatively wide width;

wherein the first and the second heating resistor strips are made of a same resistive material, wherein the second heating resistor strip is formed with a plurality of slits each elongated longitudinally within the second heating resistor strip, wherein each of the slits extends throughout the second heating resistor strip in a thickness direction of the strip, and is completely surrounded by the second heating resistor strip.

2. The heater according to claim 1, further comprising a protective coating for covering the first and the second heating resistor strips, wherein the protective coating includes a smoothing layer formed between the first and the second heating resistor strips and at the slits, the protective coating also including an overcoating layer formed on the smoothing layer.

3. The heater according to claim 1, wherein the slits are formed in a plurality of rows spaced transversely of the second heating resistor strip, the slits in each row being spaced by bridges from each other longitudinally of the second heating resistor strip.

4. The heater according to claim 1, wherein one end of the first heating resistor strip is connected to one adjacent end of the second heating resistor strip via a common conductor formed on the substrate, and the other end of the first heating resistor strip being connected to a first conductor terminal formed on the substrate, the other end of the second heating resistor strip being connected to a second conductor terminal formed on the substrate.

5. A fixing apparatus comprising a fixing heater, a power supply for providing electric power with the fixing heater, and a platen roller for pressing a recording medium against the fixing heater, the fixing heater comprising:

a substrate;

a first heating resistor strip formed on the substrate and having a relatively narrow width; and a second heating resistor strip formed on the substrate substantially in parallel to the first heating resistor strip, the second heating resistor strip having a relatively wide width;

wherein the first and the second heating resistor strips are made of a same resistive material, wherein the second heating resistor strip is provided with a plurality of slits each elongated longitudinally within the second heating resistor strip, and wherein each of the slits extends throughout the second heating resistor strip in a thickness direction of the strip, and is completely surrounded by the second heating resistor strip.

6. The fixing apparatus according to claim 5, further comprising a protective coating for covering the first and the second heating resistor strips, wherein the protective coating includes a smoothing layer formed between the first and the second heating resistor strips and at the slits, the protective coating also including an overcoating layer formed on the smoothing layer.

7. The fixing apparatus according to claim 5, wherein the slits are formed in a plurality of rows spaced from each other transversely of the second heating resistor strip, the slits in each row being spaced by bridges from each other longitudinally of the second heating resistor strip.

8. The fixing apparatus according to claim 5, wherein one end of the first heating resistor strip is connected to one adjacent end of the second heating resistor strip via a common conductor formed on the substrate, the other end of the first heating resistor strip being connected to a first conductor terminal formed on the substrate, the other end of the second heating resistor strip being connected to a second conductor terminal formed on the substrate.

9. The fixing apparatus according to claim 5, wherein the platen roller presses the recording medium against the fixing heater in a position facing the first heating resistor strip.

10. The fixing apparatus according to claim 5, wherein the platen roller is rotated to move the recording medium in a medium transfer direction, the first heating resistor strip being disposed upstream from the second heating resistor strip in the medium transfer direction.

11. The fixing apparatus according to claim 10, wherein each of the slits is elongated in a direction perpendicular to the medium transfer direction.

* * * * *